US010330312B2

(12) United States Patent
Shimazu et al.

(10) Patent No.: US 10,330,312 B2
(45) Date of Patent: Jun. 25, 2019

(54) PREMIXING APPARATUS

(71) Applicant: RINNAI CORPORATION, Nagoya-shi, Aichi (JP)

(72) Inventors: Tomoyuki Shimazu, Nagoya (JP); Mitsuru Miyata, Nagoya (JP)

(73) Assignee: RINNAI CORPORATION, Aichi (JP)

( * ) Notice: Subject to any disclaimer, the term of this patent is extended or adjusted under 35 U.S.C. 154(b) by 247 days.

(21) Appl. No.: 15/453,470

(22) Filed: Mar. 8, 2017

(65) Prior Publication Data

US 2017/0276345 A1 Sep. 28, 2017

(30) Foreign Application Priority Data

Mar. 28, 2016 (JP) ..... 2016-063711
Jun. 29, 2016 (JP) ..... 2016-128709

(51) Int. Cl.
*F23N 1/02* (2006.01)
*F23D 14/06* (2006.01)
*F23D 14/62* (2006.01)

(52) U.S. Cl.
CPC ..... *F23D 14/06* (2013.01); *F23D 14/62* (2013.01); *F23N 1/027* (2013.01)

(58) Field of Classification Search
USPC ..... 431/354; 366/182.4
See application file for complete search history.

(56) References Cited

U.S. PATENT DOCUMENTS 4,553,925 A * 11/1985 Bricmont ..... F23C 7/008 137/883
2013/0294192 A1* 11/2013 Son ..... B01F 3/028 366/182.4
2015/0354810 A1 12/2015 Nakatani et al.

FOREIGN PATENT DOCUMENTS

JP 52112830 A * 9/1977 ..... F23N 1/02
JP 2015-230113 A 12/2015

* cited by examiner

*Primary Examiner* — Avinash A Savani
*Assistant Examiner* — Aaron H Heyamoto
(74) *Attorney, Agent, or Firm* — Cermak Nakajima & McGowan LLP; Tomoko Nakajima

(57) ABSTRACT

A premixing apparatus in which a downstream end of a gas supply passage having interposed therein a flow control valve is connected to a gas suction section disposed in an air supply passage on an upstream side of a fan. The premixing apparatus has: a butterfly valve as an air resistance changeover device for changing over, between high and low, a ventilation resistance in that section of the air supply passage which is on the upstream side of the gas suction section; and a gas resistance changeover device for changing over, between high and low, a ventilation resistance in that section of the gas supply passage which is on the downstream side of the flow control valve. Wind noises at the time of closing the butterfly valve can be prevented. For that purpose, in that section of the air supply passage which is on the upstream side of the gas suction section, an inner tube containing therein the butterfly valve is disposed while leaving a clearance to an inner circumferential wall surface of the air supply passage. A subsidiary passage which is parallel with a main passage inside the inner tube is constituted by the clearance between the inner circumferential wall surface of the air supply passage and an outer peripheral surface of the inner tube.

4 Claims, 4 Drawing Sheets

PREMIXING APPARATUS

TECHNICAL FIELD

The present invention relates to a premixing apparatus for mixing fuel gas with air to supply thus obtained air-fuel mixture, through a fan, to a burner.

BACKGROUND ART

As this kind of premixing apparatus, the following is known in JP-A-2015-230113; that is, a downstream end of that gas supply passage for supplying fuel gas which has interposed therein a flow control valve, is connected to a gas suction section disposed in an air supply passage on an upstream side of the fan. The premixing apparatus comprises: an air resistance changeover means for changing over, between high and low, a ventilation resistance in that section of the air supply passage which is on an upstream side of the gas suction section; and a gas resistance changeover means for changing over, between high and low, a ventilation resistance in that section of the gas supply passage which is on the downstream side of the flow control valve.

By the way, in case a proportional valve is used as the flow control valve, the proportional valve is controlled so that the fuel gas can be supplied in amount depending on the required combustion amount. Further, the fan revolution is controlled depending on the required combustion amount so that the air-fuel ratio of the air-fuel mixture to be supplied to the burner becomes constant. However, in case the required combustion amount falls below a predetermined value and, as a result, the fan revolution has fallen below a lower limit revolution below which the proportional characteristics of the air supply volume cannot be maintained, or in case the electric current to the proportional valve (electric current to be charged to the proportional valve) has fallen below a lower limit electric current below which the proportional characteristics of the gas supply amount cannot be maintained, the air or fuel gas in amount depending on the required combustion amount can no longer be supplied.

In addition, as the flow control valve, there is a case in which is used a zero governor that maintains the secondary gas pressure to the atmospheric pressure. In this case, the amount of fuel gas supply varies with the differential pressure between the atmospheric pressure that is the secondary gas pressure and the negative pressure inside the air supply passage. And since the negative pressure inside the air supply passage varies with the fan revolution, the amount of fuel gas supply varies with the fan revolution, i.e., the amount of air supply. It follows that, by controlling the fan revolution depending on the required combustion amount, the amount of air and fuel gas depending on the required combustion amount will be supplied to the burner.

Also in this arrangement, if the fan revolution has fallen below a lower limit revolution at which the proportional characteristics of the air supply amount can be maintained, the air or fuel gas depending on the required fuel amount can no longer be supplied. Therefore, when the required combustion amount has fallen below a predetermined amount, it is necessary to increase the ventilation resistance in the air supply passage by the air resistance changeover means. Then, without making the fan revolution below the above-mentioned lower limit value, the amount of air depending on the required combustion amount below the predetermined value can be supplied. Further, only by increasing the ventilation resistance in the air supply passage, the amount of fuel gas supply will exceed the amount corresponding to the required combustion amount due to an increase in the negative pressure in the air supply passage. It is therefore necessary also to increase the ventilation resistance in the gas supply passage at the time when the ventilation resistance in the air supply passage is increased.

As a solution, in the above-mentioned prior art example, the following arrangement is employed; that is, when the required combustion amount has fallen below the predetermined value, the ventilation resistance in the air supply passage is increased by the air flow resistance changeover means, and also the ventilation resistance is increased by the gas flow resistance changeover means so that the amount of air and fuel gas can be supplied depending on the required combustion amount below the predetermined value.

In the above-mentioned prior art described in JP-A-2015-230113, the air resistance changeover means is constituted by a butterfly valve that is rotatably disposed in a section of the air supply passage that is on an upstream side of the gas suction section. In this arrangement, however, when the butterfly valve is rotated into a closed posture at right angles to the longitudinal direction of the air supply passage, the flow passage in the air supply passage will suddenly be throttled into an annular clearance between the inner circumferential wall surface of the air supply passage and the outer peripheral edge of the butterfly valve. As a result, there will be generated turbulence in the air flow, whereby wind noise is generated at the annular clearance, giving rise to noises.

SUMMARY

Technical Problem

In view of the above point, this invention has a problem of providing a premixing apparatus in which, irrespective of the fact that the air resistance changeover means is constituted by a butterfly valve, the wind noise can be reduced.

Solution to Problem

In order to solve the above problem, this invention is a premixing apparatus for mixing fuel gas with air to supply thus obtained air-fuel mixture, through a fan, to a burner, in which a downstream end of a gas supply passage having interposed therein a flow control valve for supplying fuel gas is connected to a gas suction section disposed in an air supply passage on an upstream side of the fan, the premixing apparatus comprising: an air resistance changeover means for changing over, between high and low, a ventilation resistance in that section of the air supply passage which is on an upstream side of the gas suction section; and a gas resistance changeover means for changing over, between high and low, a ventilation resistance in that section of the gas supply passage which is on the downstream side of the flow control valve. The air resistance changeover means is constituted by a butterfly valve rotatably disposed in that section of the air supply passage which is on an upstream side of the gas suction section. The premixing apparatus is characterized in: that, in that section of the air supply passage which is on the upstream side of the gas suction section, an inner tube containing therein the butterfly valve is disposed while leaving a clearance to an inner circumferential wall surface of the air supply passage, and; that a subsidiary passage which is parallel with a main passage inside the inner tube is constituted by the clearance between the inner circumferential wall surface of the air supply passage and an outer peripheral surface of the inner tube.

According to this invention, when the butterfly valve is rotated to a closed posture at right angles to the longitudinal direction of the main passage, the main passage will almost be closed. As a result, the air flow is substantially limited to the subsidiary passage, and the ventilation resistance in the air supply passage will become high. It is to be noted here that the air to flow through the subsidiary passage will attain a state of laminar flow guided, both inside and outside, by the outer peripheral surface of the inner tube and the inner circumferential wall surface of the air supply passage. As a consequence, the wind noise (aerodynamic noise) that is generated in the closed posture of the butterfly valve can be reduced.

By the way, that half part of the butterfly valve which displaces in the upstream direction of the main passage when the butterfly valve is rotated from the closed posture into an opened posture in parallel with the longitudinal direction of the main passage is defined as a first-half part, and that half part of the butterfly valve which displaces in the downstream direction of the main passage is defined as a second-half part. If that peripheral corner portion of the side surface of the first-half part which faces the downstream direction of the main passage in the closed posture, and that peripheral corner portion of the side surface of the second-half part which faces the upstream direction of the main passage in the closed posture are squarish or angularized, i.e., the following disadvantages will occur; namely, at an initial stage of rotation from the closed posture of the butterfly valve, these peripheral corner portions will get closer to the inner circumferential surface of the inner tube, whereby the clearance between the inner circumferential surface of the inner tube and the butterfly valve will be narrowed. As a result, the velocity of the air that flows through this clearance increases, and the wind noise comes to be likely to occur. As a solution, in this invention, it is preferable to form the above-mentioned peripheral corner portion into a rounded shape. According to this arrangement, at the initial stage of rotation from the closing posture of the butterfly valve, the above peripheral corner portions will not come closer to the inner circumferential surface of the inner tube, whereby the above disadvantages will not occur.

In addition, when the butterfly valve is rotated from the closed posture, the first-half part of the butterfly valve will be inclined in the upstream direction of the main passage. As a result, turbulence will occur in the air flow that flows into the clearance between the inner circumferential surface of the inner tube and the first-half part. If the velocity of this air flow is fast, wind noise is likely to be generated. As a solution, in this invention, preferably, the inner tube further comprises a communication section for bringing the main passage and the subsidiary passage into communication with each other, the communication section being positioned on the upstream side of the butterfly valve in its closed posture and also being positioned on the side of the first-half part. According to this arrangement, that part of the air in the main passage which is directed toward the clearance between the inner circumferential surface of the inner tube and the first-half part is diverged, through the communication section, into the subsidiary passage. Therefore, the amount of air that flows into the clearance between the inner circumferential surface of the inner tube and the first-half part decreases and, as a result, the flow velocity of the air flow through this clearance will become smaller, whereby the generation of the wind noise can be limited.

Further, this invention preferably comprises a Venturi section disposed in that section of the air supply passage which is adjacent to the upstream side of the gas suction section, the Venturi section being smaller in diameter than that section of the air supply passage which is provided with the inner tube. The inner circumferential wall surface of that section of the air supply passage which lies between the subsidiary passage and the Venturi section is formed into a tapered surface that is reduced in diameter toward the Venturi section. According to this arrangement, also when the butterfly valve is rotated to the closed posture so that the ventilation resistance in the air supply passage increases, the air that has passed through the subsidiary passage flows smoothly along the tapered surface into the Venturi section, whereby the negative pressure in the Venturi section can be secured. As a result, the fuel gas is stably suctioned from the gas suction section adjacent to the Venturi section, thereby maintaining constant the air-fuel ratio of the air-fuel mixture.

DESCRIPTION OF EMBODIMENTS

Figure 1:
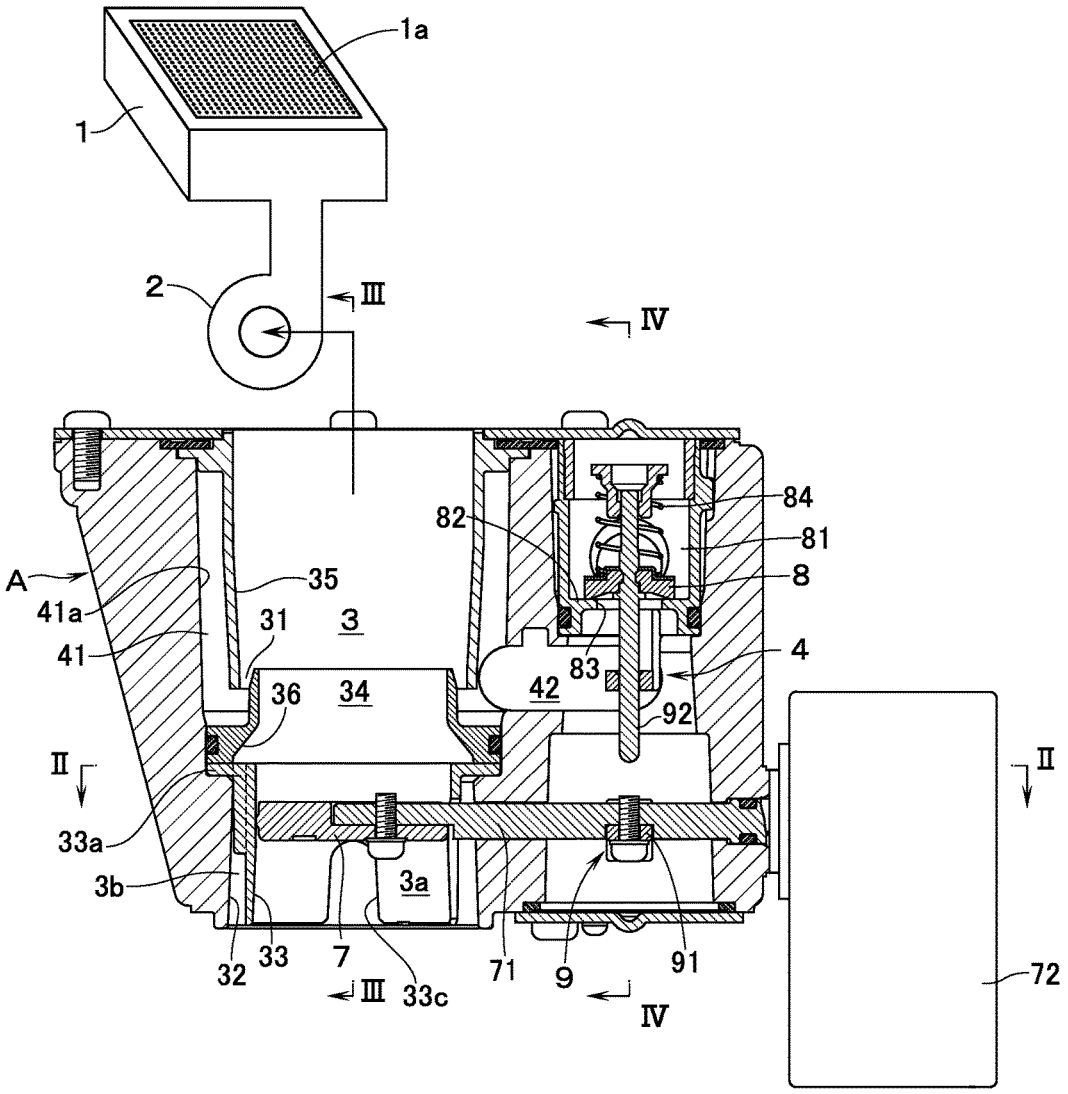
FIG. 1 is a side view, partly shown in section, of a premixing apparatus according to an embodiment of this invention.

With reference to FIG. 1, reference numeral 1 denotes a burner which is made up of a totally aerated combustion type burner (also called "all primary air burner") and the like having a combustion surface 1*a* in which the air-fuel mixture is ejected and combusted. The burner 1 has connected thereto a fan 2 and, by means of a premixing apparatus A according to an embodiment of this invention, the fuel gas is mixed with air so that air-fuel mixture is supplied to the burner 1 via the fan 2.

Figure 4:
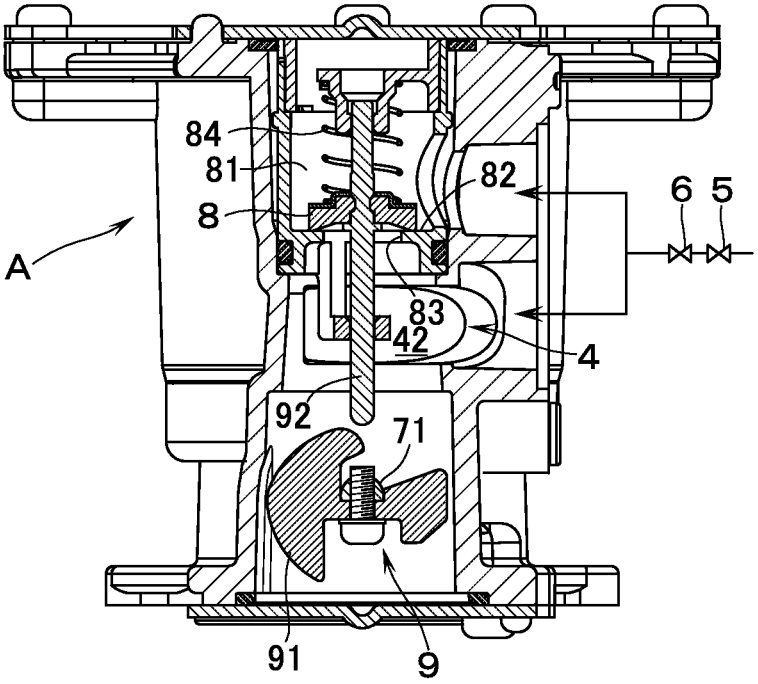
FIG. 4 is a sectional view partly cut away along the line IV-IV in FIG. 1.

The premixing apparatus A is provided with an air supply passage 3 on the upstream side of the fan 2, and a gas supply passage 4 to supply a fuel gas. In the upstream section of the gas supply passage 4, there are interposed an on-off valve 5, and a flow control valve 6 which is made up of a proportional valve or a zero governor as shown in FIG. 4. Further, the downstream end of the gas supply passage 4 is connected to a gas suction section 31 which is disposed in the air supply passage 3. In addition, the premixing apparatus A is provided with: an air resistance changeover means for changing over, between high and low, a ventilation resistance in that section of the air supply passage 3 which is on an upstream side of the gas suction section 31; and a gas resistance changeover means for changing over, between high and low, a ventilation resistance in that section of the gas supply passage 4 which is on the downstream side of the flow control valve 6.

Figure 2:
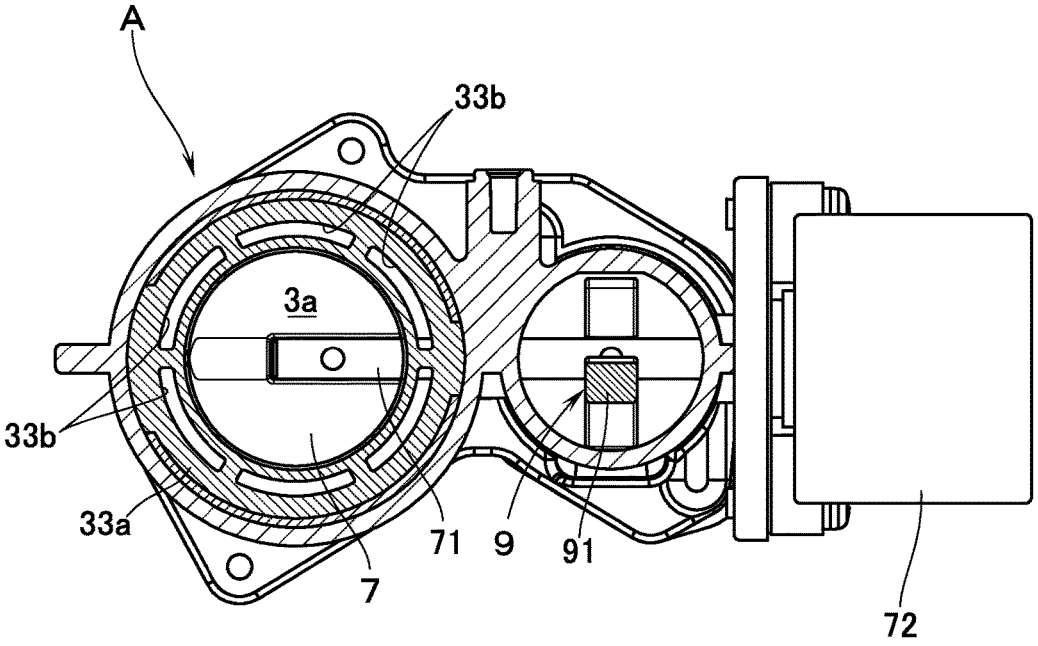
FIG. 2 is a plan view partly cut away along the line II-II in FIG. 1.
Figure 3:
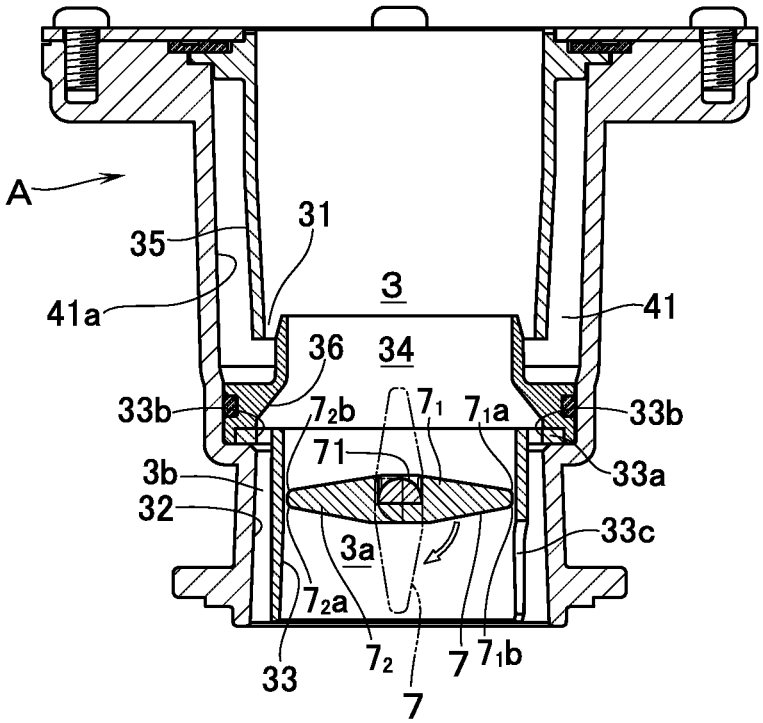
FIG. 3 is a sectional view partly cut away along the line III-III in FIG. 1.

With reference also to FIGS. 2 and 3, the air resistance changeover means is constituted by a butterfly valve 7 made up of a disc that is disposed inside the air supply passage 3 so as to be rotatable about a shaft 71. The shaft 71 of the butterfly valve 7 has connected thereto an actuator 72 such as a stepping motor and the like. When the required combustion amount has fallen below a predetermined value, the actuator 72 is operated to rotate the butterfly valve 7 from the opened posture at which the butterfly valve 7 lies along the longitudinal direction of the air supply passage 3 as shown by imaginary lines in FIG. 3 to the closed posture at right angles to the longitudinal direction of the air supply passage 3 as shown in solid lines in FIGS. 1 through 3.

The gas supply passage 4 is provided with a valve chamber 81 which is positioned on the upstream side of a downstream-end gas chamber 41 which is in communication with the gas suction section 31. The valve chamber 81 is in parallel with a passage section 42 that is normally communicated with the gas chamber 41. Inside the valve chamber 81, there is provided a changeover valve 8 for opening or closing a valve hole 83. The valve hole 83 is formed in a valve seat 82 at the lower end of the valve chamber 81 in a manner to be in communication with the passage section 42. The gas resistance changeover means is constituted by this changeover valve 8. When the changeover valve 8 is closed, the flow of the gas through the valve chamber 81 is shut off, and the ventilation resistance in the gas supply passage 4 increases.

The changeover valve 8 is operated to be opened or closed through an interlocking mechanism 9 accompanied by the rotation of the butterfly valve 7. This interlocking mechanism 9 is constituted, as shown in FIGS. 1 and 4, by: a cam 91 which is coupled to the shaft 71 of the butterfly valve 7; and a rod 92 which is coupled to the changeover valve 8 and one end of which is capable of coming into contact with the cam 91. When the butterfly valve 7 is rotated into the opened posture, the rod 91 is pushed up by the cam 91. The changeover valve 8 is then opened against an urging (or pushing) force of a valve spring 84. On the other hand, when the butterfly valve 7 is rotated into the closed posture, the upward pushing of the rod 92 by the cam 91 is released. The changeover valve 8 is thus closed by the urging force of the valve spring 84.

In this embodiment, in that section of the air supply passage 3 which is on the upstream side of the gas suction section 31, there is provided an inner tube 33 for containing therein the butterfly valve 7, while leaving a clearance to the inner circumferential wall surface 32 of the air supply passage 3. A subsidiary passage 3*b* which is parallel with the main passage 3*a* inside the inner tube 33 is constituted by the clearance between the inner circumferential wall surface 32 of the air supply passage 3 and the outer peripheral surface of the inner tube 33. By the way, in the flange section 33*a* on a downstream end (upper end in FIGS. 1 and 3) of the inner tube 33, there are formed a plurality of arcuate through holes 33*b* so as to serve as outlets to the subsidiary passage 3*b*.

When the butterfly valve 7 is rotated to the closed posture at right angles to the longitudinal direction of the main passage 3*a*, the main passage 3*a* will almost be closed. As a result, the flow of the air is substantially limited to the subsidiary passage 3*b*, and the ventilation resistance in the air supply passage 3 will increase. The air that flows through the subsidiary passage 3*b* will attain a state of laminar flow guided, along the inside and along the outside, by both the outer peripheral surface of the inner tube 33 and the inner circumferential wall surface 32 of the air supply passage 3. Therefore, the wind noise that will be generated in the closed posture of the butterfly valve 7 can be reduced.

Suppose that half part of the butterfly valve 7 which displaces in the upstream direction of the main passage 3*a* when the butterfly valve is rotated from the closed posture into the opened posture in parallel with the longitudinal direction of the main passage 3*a* is defined as a first-half part $\mathbf{7}_1$, and that half part of the butterfly valve 7 which displaces in the downstream direction of the main passage 3*a* is defined as a second-half part $\mathbf{7}_2$. That peripheral corner portion $\mathbf{7}_1a$ of the side surface of the first-half part $\mathbf{7}_1$ which faces the downstream side of the main passage 3*a* in the closed posture, and that peripheral corner portion $\mathbf{7}_2a$ of the side surface of the second-half part $\mathbf{7}_2$ which faces the upstream side of the main passage 3*a* in the opened posture are both formed into rounded shapes. In this embodiment, that peripheral corner portion $\mathbf{7}_1b$ of the side surface of the first-half part $\mathbf{7}_1$ which faces the upstream direction of the main passage 3*a* in the closed posture, and that peripheral corner portion $\mathbf{7}_2b$ of the side surface of the second-half part $\mathbf{7}_2$ which faces the downstream direction of the main passage 3*a* in the closed posture are also both formed into rounded shapes. Alternatively, these peripheral corner portions $\mathbf{7}_1b$, $\mathbf{7}_2b$ may be of angularized shape.

If the above-mentioned peripheral corner portions $\mathbf{7}_1a$, $\mathbf{7}_2a$ are of angularized shapes, at the initial stage of rotation from the closed posture of the butterfly valve 7, the peripheral corner portions $\mathbf{7}_1a$, $\mathbf{7}_2a$ come close to the inner circumferential surface of the inner tube 33 so that the clearance between the inner circumferential surface of the inner tube 33 and the butterfly valve 7 is narrowed. The flow velocity of the air to flow through the clearance increases, giving rise to disadvantages in that the wind noise is likely to be generated. On the other hand, when the peripheral corner portions $\mathbf{7}_1a$, $\mathbf{7}_2a$ are formed into rounded shapes, at the initial stage of rotation of the butterfly valve 7 from the closed posture, the peripheral corner portions $\mathbf{7}_1a$, $\mathbf{7}_2a$ will not come closer to the inner circumferential surface of the inner tube 33, thereby giving rise to no such disadvantages as noted above.

In addition, when the butterfly valve 7 is rotated from the closed posture, the first-half part $\mathbf{7}_1$ of the butterfly valve 7 will be inclined toward the upstream direction of the main passage 3*a*. As a result, turbulence will be generated in the air flow that flows in through the clearance between the inner circumferential surface of the inner tube 33 and the first-half part $\mathbf{7}_1$. If this velocity of the air flow is fast, wind noise is likely to be generated. As a solution, in this embodiment, the inner tube 33 has formed therethrough a communication section 33*c* which is positioned on the upstream side of the butterfly valve 7 in the closed posture and also which is positioned on the side of the first-half part $\mathbf{7}_1$ of the butterfly valve 7. According to this arrangement, part of the air that is directed toward the clearance between the inner circumferential surface of the inner tube 33 and the first-half part $\mathbf{7}_1$ is diverged through the communication section 33*c* into the subsidiary passage 3*b*. Therefore, the amount of air that flows into the clearance between the inner circumferential surface of the inner tube 33 and the first-half part $\mathbf{7}_1$ decreases and, as a result, the flow velocity of the air flow through this clearance will be smaller, whereby the generation of the wind noise can be limited. By the way, the communication section 33*c* is constituted by a notch that extends from the position nearby the butterfly valve 7 in the closed posture to the upstream end of the inner tube 33, but the communication section 33*c* may also be constituted by an elongated slot.

That section of the air supply passage 3 which is adjacent to the upstream side of the gas suction section 31 is provided with a Venturi section 34 which is smaller in diameter than the section of the air supply passage 3 in which the inner cylinder 33 is disposed. That section of the air supply passage 3 which is adjacent to the downstream side of the Venturi section 34, is enclosed by a cylindrical section 35 which is larger in diameter than the Venturi section 34. Then, the downstream end section of the Venturi section 34 is inserted, with an annular clearance, into an upstream end of the cylindrical section 35. It is thus so arranged that this clearance constitutes the gas suction section 31 which is in communication with the gas chamber 41 by this clearance. The gas chamber 41 is constituted by a clearance between the tubular section 35 and the outer wall surface 41*a* that encloses the tubular section 35.

The inner circumferential wall surface of the air supply passage 3 between the subsidiary passage 3*b* and the Venturi section 34 is formed into a tapered surface 36 with a smaller diameter toward the Venturi section 34. According to this arrangement, even when the butterfly valve 7 is rotated to the closed posture so that the ventilation resistance of the air supply passage 3 is made higher, the air that flows through subsidiary passage 3*b* can flow smoothly into the Venturi section 34 along the tapered surface 36, whereby the negative pressure can be secured at the Venturi section 34. As a result, the fuel gas is suctioned stably from the gas suction section 31 that is adjacent to the Venturi section 34, whereby the air-fuel ratio of the air-fuel mixture can be maintained constant.

Description has so far been made of an embodiment of this invention with reference to the figures. This invention, however, shall not be limited to the above. For example, in the above-mentioned embodiment, the gas resistance changeover means is constituted by a changeover valve which opens or closes the valve hole 83. It is, however, possible to constitute the gas resistance changeover means by a needle valve and the like that varies the opening of the valve hole that is provided on the way of the gas supply passage 4.

REFERENCE SIGNS LIST

A premixing apparatus
1 burner
2 fan
3 air supply passage
3*a* main passage
3*b* subsidiary passage
31 gas suction section
32 inner circumferential wall surface of the air supply passage
33 inner tube
34 Venturi section
36 tapered surface
4 gas supply passage
6 flow control valve
7 butterfly valve
8 changeover valve (gas resistance changeover means)

What is claimed is:

1. A premixing apparatus for mixing fuel gas with air to supply thus obtained air-fuel mixture, through a fan, to a burner, in which a downstream end of a gas supply passage having interposed therein a flow control valve for supplying fuel gas is connected to a gas suction section disposed in an air supply passage on an upstream side of the fan, the premixing apparatus comprising:

an air resistance changeover device for changing over, between high and low, a ventilation resistance in that section of the air supply passage which is on an upstream side of the gas suction section; and a gas resistance changeover device for changing over, between high and low, a ventilation resistance in that section of the gas supply passage which is on the downstream side of the flow control valve, wherein the air resistance changeover device is constituted by a butterfly valve rotatably disposed in that section of the air supply passage which is on an upstream side of the gas suction section, wherein in that section of the air supply passage which is on the upstream side of the gas suction section, an inner tube containing therein the butterfly valve is disposed while leaving a clearance to an inner circumferential wall surface of the air supply passage, and;

that a subsidiary passage which is parallel with a main passage inside the inner tube is constituted by the clearance between the inner circumferential wall surface of the air supply passage and an outer peripheral surface of the inner tube, and the main passage and the subsidiary passage supply air to the gas suction section.

2. The premixing apparatus according to claim 1, where that half part of the butterfly valve which displaces in the upstream direction of the main passage when the butterfly valve is rotated from the closed posture at right angles to the longitudinal direction of the main passage into the opened posture in parallel with the longitudinal direction of the main passage is defined as a first-half part, and where that half part of the butterfly valve which displaces in the downstream direction of the main passage is defined as a second-half part, wherein that peripheral corner portion of the side surface of the first-half part which faces the downstream direction of the main passage in the closed posture, and that peripheral corner portion of the side surface of the second-half part which faces the upstream direction of the main passage in the closed posture are both formed into rounded shapes.

3. The premixing apparatus according to claim 1, where that half part of the butterfly valve which displaces in the upstream direction of the main passage when the butterfly valve is rotated from the closed posture at right angles to the longitudinal direction of the main passage into the opened posture in parallel with the longitudinal direction of the main passage is defined as a first-half part, and where that half part of the butterfly valve which displaces in the downstream direction of the main passage is defined as a second-half part, wherein the inner tube further comprises a communication section for bringing the main passage and the subsidiary passage into communication with each other, the communication section being positioned on the upstream side of the butterfly valve in its closed posture and also being positioned on the side of the first-half part.

4. The premixing apparatus according to claim 1, further comprising a Venturi section disposed in that section of the air supply passage which is adjacent to the upstream side of the gas suction section, the Venturi section being smaller in diameter than that section of the air supply passage which is provided with the inner tube, wherein the inner circumferential wall surface of that section of the air supply passage which lies between the subsidiary passage and the Venturi section is formed into a tapered surface that is reduced in diameter toward the Venturi section.

* * * * *